US006884188B2

(12) United States Patent
Cherry

(10) Patent No.: US 6,884,188 B2
(45) Date of Patent: Apr. 26, 2005

(54) PORTABLE PITCHING MACHINE

(75) Inventor: Kim N. Cherry, Star, ID (US)

(73) Assignee: Sling Pitcher, Inc., Star, ID (US)

( * ) Notice: Subject to any disclaimer, the term of this patent is extended or adjusted under 35 U.S.C. 154(b) by 0 days.

(21) Appl. No.: 10/441,430

(22) Filed: May 19, 2003

(65) Prior Publication Data

US 2004/0235590 A1 Nov. 25, 2004

(51) Int. Cl.[7] ..... A63B 69/00; F41B 7/00

(52) U.S. Cl. ..... 473/451; 473/422; 124/17; 124/20.1; 124/20.2

(58) Field of Search ..... 473/422, 431, 473/451, 460; 124/6, 7, 20.1, 16, 17

(56) References Cited

U.S. PATENT DOCUMENTS

| | | | | |
|---|---|---|---|---|
| 2,974,954 A | * | 3/1961 | Martin | 472/54 |
| 4,252,490 A | * | 2/1981 | Keller | 414/434 |
| 4,269,162 A | * | 5/1981 | Abraham et al. | 124/7 |
| 4,873,964 A | * | 10/1989 | Bonoan | 124/20.1 |
| 5,249,564 A | | 10/1993 | Peachey | |
| 5,303,695 A | * | 4/1994 | Shopsowitz | 124/17 |
| 5,383,657 A | * | 1/1995 | Rathmell | 124/17 |
| 5,398,665 A | | 3/1995 | Carlson | |
| 5,431,145 A | * | 7/1995 | Strait et al. | 124/17 |
| 5,439,212 A | * | 8/1995 | Hart | 124/7 |
| 5,657,984 A | * | 8/1997 | Leo | 124/20.1 |
| 5,660,386 A | | 8/1997 | Krieger | |
| 5,769,064 A | | 6/1998 | Lu et al. | |
| 5,996,565 A | | 12/1999 | Whitmer | |
| 6,004,233 A | * | 12/1999 | Raubuck et al. | 473/505 |
| 6,213,574 B1 | | 4/2001 | Pierce | |

OTHER PUBLICATIONS

Copy of International Search Report.

* cited by examiner

*Primary Examiner*—Mitra Aryanpour
(74) *Attorney, Agent, or Firm*—Stephen M. Nipper; Dykas, Shaver & Nipper

(57) ABSTRACT

A portable pitching machine for pitching balls to a batter. The portable pitching machine convertible from a storage mode to an in use mode. When in the storage mode, the portable pitching machine configured for storage within a container. The portable pitching machine having a frame, a plurality of elastic connectors, a pair of uprights extending from the frame, and a pocket for containing a ball. The portable pitching machine having a seat upon which a user sits, wherein interposed between the seat and the uprights is the open top container.

16 Claims, 6 Drawing Sheets

PORTABLE PITCHING MACHINE

BACKGROUND OF THE INVENTION

1. Field of the Invention

The present invention generally relates to devices and apparatuses used to train athletes to hit a moving ball, and more particularly relates to pitching machines utilized by a coach to fire a ball towards a batter, with the pitching machine utilizing elastic bands or straps for propulsion of the ball.

2. Background Information

The training of athletes, namely baseball and softball players, to properly hit baseballs/softballs is frequently done. Typically, a batter will spend time within a "batting cage" receiving balls pitched by a commercial pitching machine. Alternatively, portable pitching machines are known in the prior art and are utilized by coaches to pitch balls to batters.

There are many disadvantages in the prior art. A first disadvantage is the fact that balls are often fired along a generally constant flight path through use of a mechanized pitching machine that can be aimed differently and the motor on the machine can be sped up and/or slowed down. In addition, it is generally difficult to deliver to a batter balls pitched at a great variety of pitching speeds and pitching locations in real time.

A second disadvantage to the utilization of commercial pitching machine equipment is cost. These commercial pitching machines typically utilize actual baseballs or softballs as the propelled ball. Such units are typically expensive to purchase, own, and operate. Additionally, such units typically require some type of netting to contain the pitched and hit balls.

An additional concern is that mechanical pitching machines are typically powered through the use of an electrical motor, thereby requiring the utilization of the unit in an area that has convenient access to an electrical power supply.

What is needed is a less expensive, easy to use, adjustable, variable speed, non-motorized, portable pitching machine that is self-contained, allows an operator to shoot balls toward a ball player by using an elastic sling type pouch, is used for the purpose of hitting or fielding practice, and allows the operator to comfortably position himself or herself on top of the apparatus and behind the projection sling pouch for convenient and accurate operation. The apparatus allows the operator to easily adjust the speed and location of each pitch by simply adjusting the point of release of the ball pouch. The apparatus preferably utilizing perforated plastic balls. Embodiments of the present invention satisfy this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a compact field pitching machine that utilizes four or more elastic bands and a pouch system to propel a ball, preferably a perforated baseball or softball sized plastic ball. The purpose of this device is to be able to propel the balls easily and accurately for the purpose of batting practice and also for training in the mechanics of fielding for both infielders and catchers. While the present invention is described with reference to softball and baseball, such a use is not intended to be a limitation.

In one embodiment of the present invention, a portable pitching machine is convertible from a storage mode to an in use mode. As such, this embodiment is provided with a storage container, such as a bag or box, into which a storage mode conversion of the invented pitching machine can be stored. This storage container preferably having a handle allowing for a user to conveniently carry the invented pitching machine from one location to the next and to provide convenient and compact storage of the device.

The portable pitching machine comprising a frame, a plurality of elastic connectors, a pair of uprights extending from the frame, and a pocket for containing one or more balls to be pitched.

The frame having a plurality of legs that are configured for resting upon a ground surface, such as a playing field. The frame comprising a seat that is configured for sitting upon by a user, such as a coach or another player. This frame also defining an open top container therein for storing a number of balls within the frame. This open top container configured to be accessible by a user sitting upon the seat. The open top container furthermore is preferably located between the seat and a pair of uprights extending from the frame. As such, a coach can easily grab a ball and pitch it without needing to move or change his/her position.

When the invented device is within its storage mode, the seat is moved (or the frame is moved) so that the seat forms the top for the open top container, thereby serving to encase any balls contained within the container. When in use, the seat does not comprise a top for the open top container.

The elastic connectors are preferably lengths of standard surgical tubing. Being lengths of standard surgical tubing, they are convenient and easy to repair and replace for a user. Each of these elastic tubing lengths having a first end extending to a second end. While the invention prefers the utilization of single lengths of surgical tubing, other types of elastic and stretchable materials are also envisioned being used, including the utilization of loops of surgical tubing rather than lengths of surgical tubing.

Extending from the frame, preferably, are the pair of uprights. These uprights having a plurality of connection pins attaching to or extending there from. These connection pins configured for attachment to the first ends of the elastic connectors. These connection pins are of a diameter allowing for the surgical tubing to be slid tightly over the connection pins thereby forming a solid, friction fit. Other manners of attaching the elastic connectors to the uprights are likewise envisioned.

The pocket of the present invention is utilized to hold one of the balls while the pocket is drawn backwards, stretching the elastic connectors. When the desired stretching distance is reached, the pocket is released and the ball is propelled forward. The pocket defines a rim, this rim comprising a number of connection barbs there from. In one embodiment, these connection barbs attach to the pocket and are configured for receiving in a friction fit the second ends of the elastic connectors thereby fixedly attaching them thereon.

The preferred embodiment of the present invention is portable and configured to collapse into a compact package, thus making it easy to store and transport. The apparatus includes a ball storage system making the balls readily accessible when operating the apparatus and providing a storage compartment to contain the balls when not in use. There is also a carrying case.

The present invention has several features that make it unique over any other type of pitching machine known to be available. It is easy and simple to operate. It takes only minutes to set up, whether in the backyard, a park or on a playing field. When using plastic perforated balls, the present invention closely simulates a live pitching situation. The fear or concern of using a pitching machine to throw regulation baseballs or softballs is eliminated and thus the present invention makes it ideal for less experienced players. Use of helmets and other protective gear is not necessary when shooting the plastic balls. An additional advantage is that no batting cage or protective cage for the pitcher is needed when utilizing plastic balls. The location and speed of each pitch can be adjusted and controlled by the operator. A great advantage of the present invention is that it promotes parent/child participation.

Further, the purpose of the Abstract of the Disclosure is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein is shown and described only the preferred embodiment of the invention, simply by way of illustration of the best mode contemplated by carrying out the invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
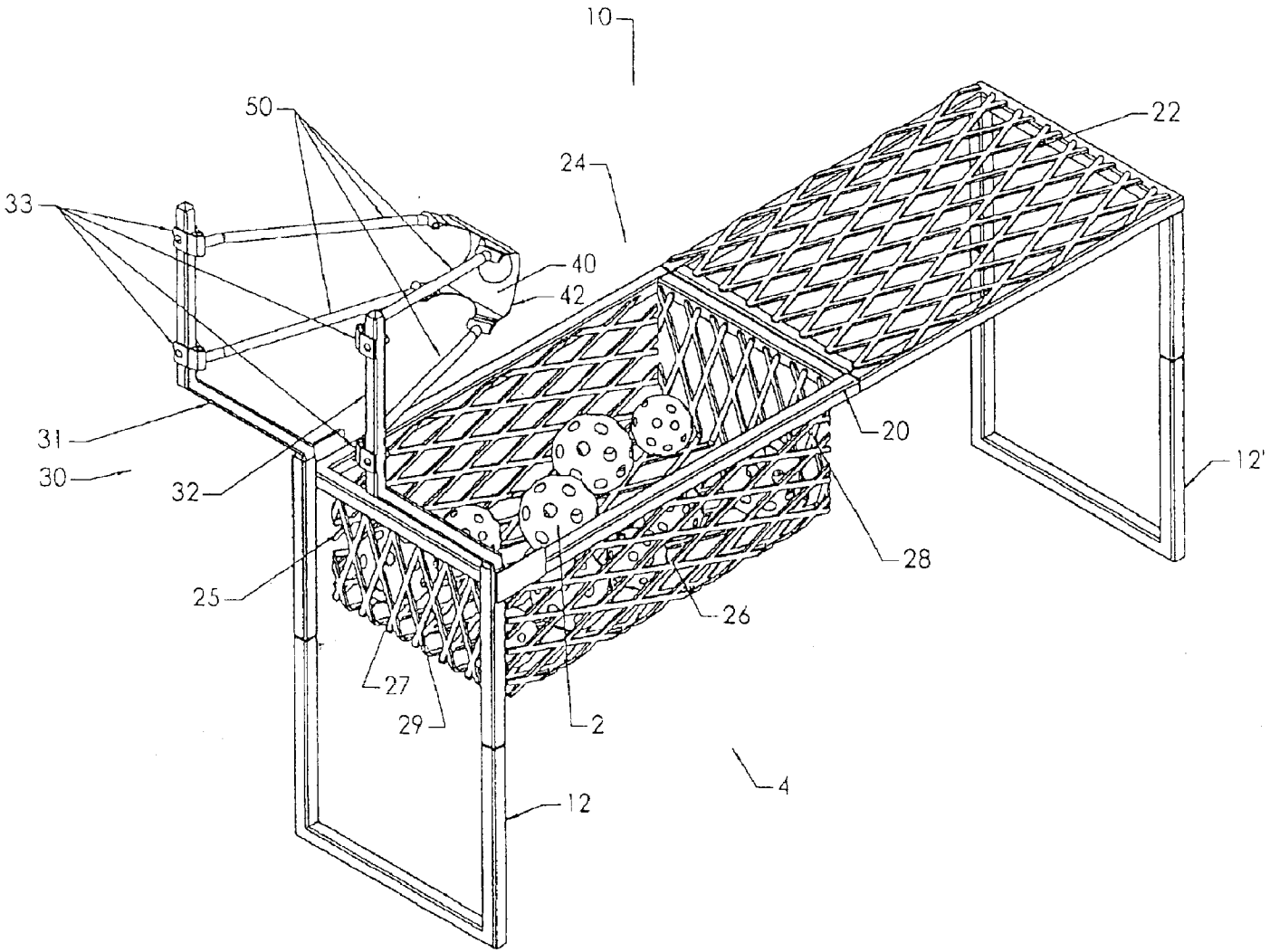
FIG. 1 shows a perspective view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring to FIG. 1, shown is one embodiment of the portable pitching machine 10. This portable pitching machine 10 comprising a frame 20, a pair of uprights 31, 32, a pocket 40, and a plurality of elastic connectors 50. The portable pitching machine 10 having extending downwards there from a plurality of legs 12, 12' for supporting the present invention upon a ground surface 4. While the embodiment shown utilizes a pair of "U-shaped" legs, it is expressly envisioned that other sizes, shapes, and styles of legs can likewise be included and used with the present invention.

The frame 20 comprising a seat 22 for sitting upon by a user. The seat may or may not be padded. It is preferred that the seat have a length allowing for a user to sit a desired distance from the uprights, thereby accommodating use of the present invention by users of various heights and arm lengths.

The frame 20 further defining an open top container 24 therein for receiving therein a plurality of balls 2. This open top container for stocking balls during use and for storing balls during the transportation of the present invention. This open top container 24 being comprised of a first side 25, a second side 26, a first end 27, a second end 28, and a bottom 29. While the container shown defined within the embodiment of FIG. 1 is generally right rectangular, parallelepiped in shape, other sizes, shapes, and orientations of open top container 24 are also envisioned, including hard and soft sided containers.

Figure 2:
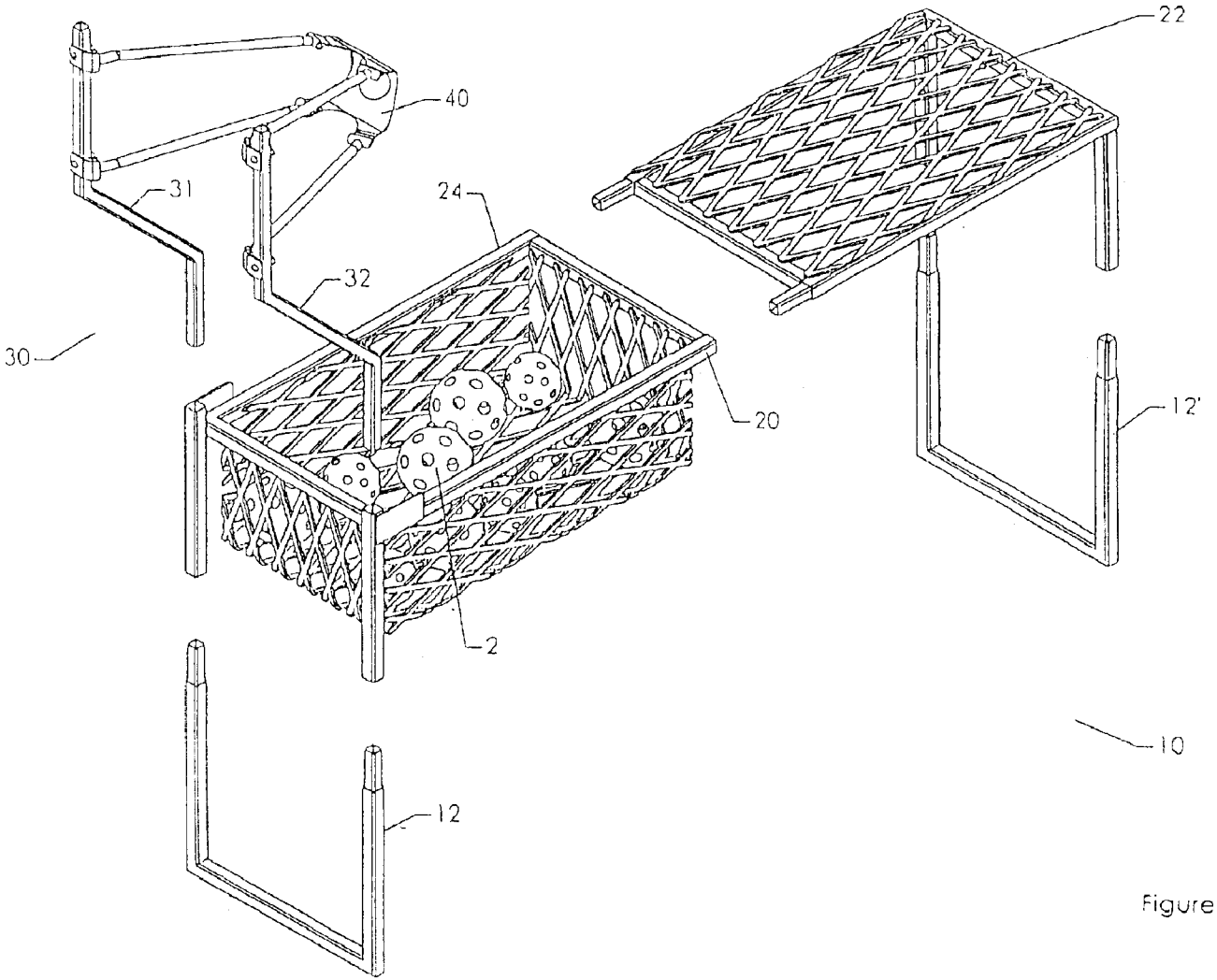
FIG. 2 shows an exploded perspective view of FIG. 1.
Figure 3:
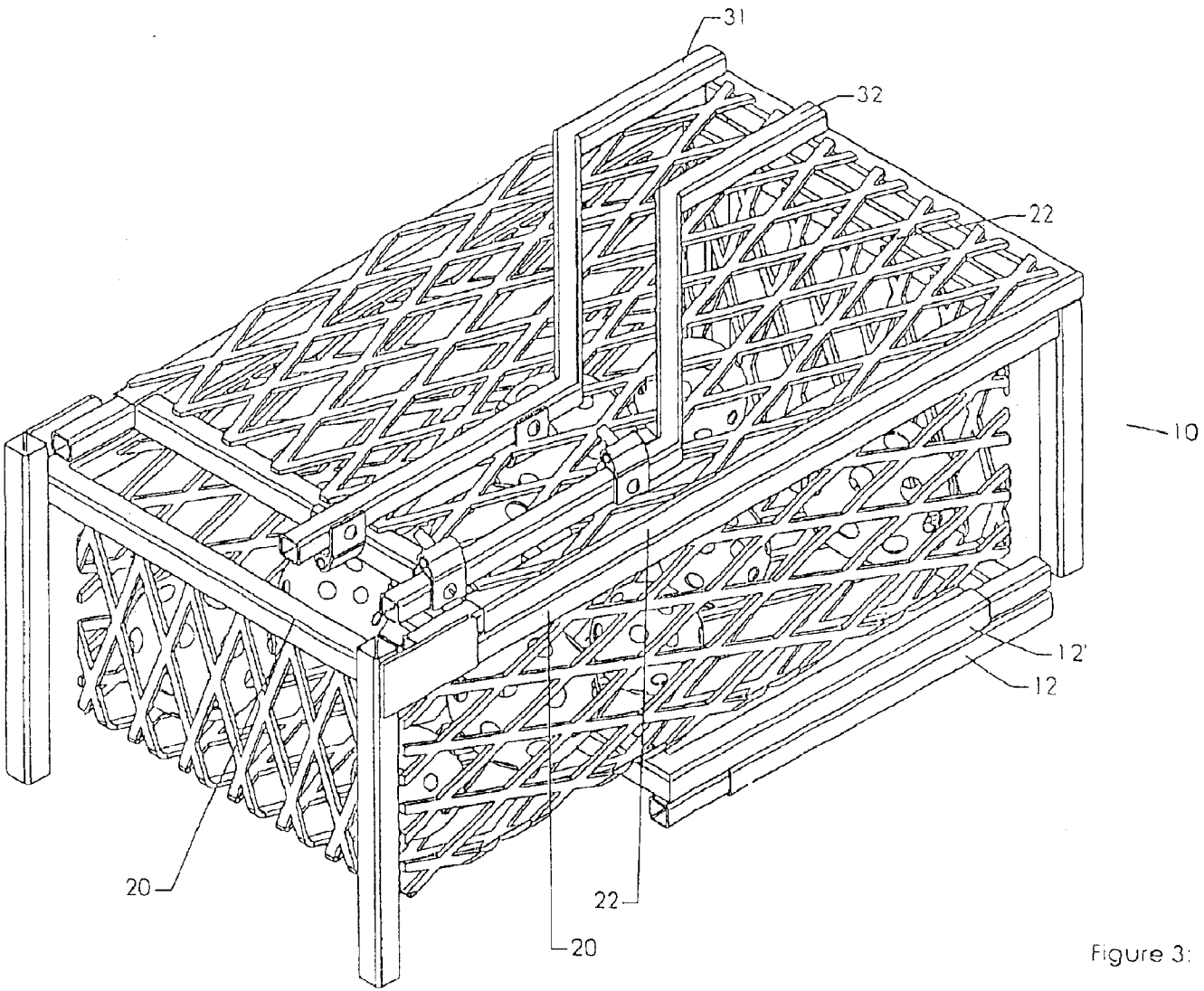
FIG. 3 shows a partial, perspective, disassembled storage view of the embodiment of the present invention shown in FIG. 1.
Figure 6:
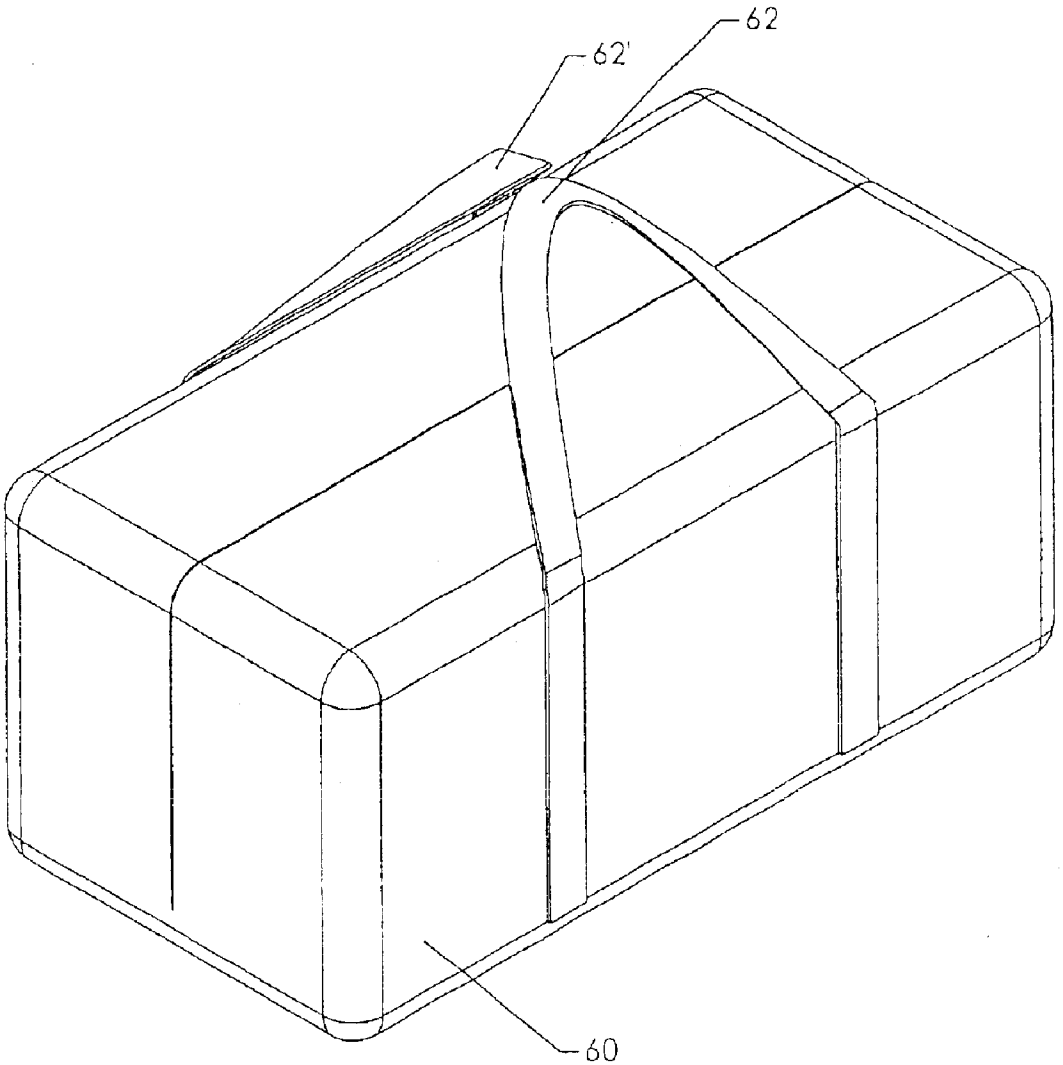
FIG. 6 shows one embodiment of a carrying bag or case utilized with embodiments of the present invention.

It is preferred that the present invention be configured to be used in an "in use" mode and a "storage" or transportation mode. FIG. 1 showing an "in use" mode, FIG. 2 showing a partially disassembled stage, and FIG. 3 showing a "storage" mode (preferably stored in bag as shown in FIG. 6). When the invented device is within its storage mode, the seat is preferably moved (or the frame is moved) so that the seat forms the top for the open top container, thereby serving to encase any balls contained within the container. When in use, the seat does not comprise a top for the open top container. Thus, the device collapses over the open top container or "basket" when the invention is disassembled for storage and transport, and in such condition, contains the balls between the basket and the seating section of the invention.

In the embodiment shown in FIG. 1, the frame 20 is comprised of tubular steel or aluminum, with a diamond pattern metal grating or flattened steel mesh, utilized for both the seat as well the sides, ends, and bottom of the open top container 24. While these materials are utilized in this embodiment of the present invention, it is likewise expressly envisioned that other materials and articles of manufacture may be utilized in the preparation and construction of the present invention, including, but not limited to, metals, plastic injection molded plastic, tubular round stock, other plastics, composites, ceramics, wood, other natural materials, etc.

Preferably extending away from the frame 20, preferably generally perpendicular to the open top container 24 and seat 22 is at least one upright assembly 30. In the embodiment shown, the upright assembly 30 comprises a pair of uprights 31, 32 that obliquely extend away from frame before extending generally perpendicular to the open top container and frame. This is done to further space the connection(s) 33 of the uprights 31, 32 from the seat portion of the frame, thereby allowing the user to stretch the elastic connectors an additional length. However, the size, shape, and orientation of the uprights can vary from the shape shown to curved, straight, zigzags, etc., depending on the intended use, preferably still providing for a compact assembly in the storage mode.

In the embodiment shown, the upright assembly 30 comprises a first upright 31 and a second upright 32. However, in other embodiments, the uprights may be interconnected (forming a "U" or "H" shape), such an embodiment adding stability to the present invention. Other suitable configurations are likewise envisioned, for instance "Y" shapes, etc. The disclosed shape of the preferred invention is not intended to be a limitation.

The uprights 31, 32 being configured for attachment to one or more elastic connectors 50. Any suitable connector 33 for attaching the elastic connectors 50 to the uprights 31, 32 is permissible. A first suitable connector style is shown in FIGS. 1–5, particularly FIGS. 4–5. This connector 33 utilizing a connection pin holder 36 for holding a T-shaped connection pin 34. This connection pin holder 36 defining a hole through which the leg of the T-shaped connection pin 34 can extend there through, this leg configured for insertion within one of said elastic connectors 50. A fastener 38, 38', such as the bolt and nut shown, is utilized to fasten the connector 33 to the upright 31, 32. Other fasteners are likewise envisioned, including, but not limited to snaps, buckles, hook-and-loop fasteners, adhesives, welds, ties, etc.

The preferred connection pin holder 36 comprised of a flexible material, such as leather, able to repeatedly flex as the present invention is operated. If the elastic connector 50 breaks, the user is able to pull the end 52 of the connector 50 off the connection pin leg 34 and reattach a new elastic connector thereon. Such ability also providing for an ease of shortening the connectors by removing the connector from the pin leg, trimming or cutting off a portion of the connector, and replacing the connector back thereon. The preferred connection pin 34 comprising a barbed hose "T" made of PVC, nylon or another suitable plastic. Metal and composite "T's" are also available and are likewise suitable.

A second suitable manner is the utilization of a plurality of connection pins attached to and extending from the uprights. These connection pins comprising rods extending from the uprights configured for receiving thereon the first ends of the elastic connectors of the present invention. In such an embodiment, the uprights comprising metal tubing and the rods comprising metal pins welded thereon. Such a connection comprises the mere sliding of the elastic connector first end onto one of said the connection pins, with friction and the elasticity of the elastic connector providing the connection. Other suitable manners are also envisioned, including, but not limited to, friction fits, adhesives, hook-and-loop type attachments, knots, clips, ties, bands, loops, continuous loops, etc.

Preferably, the elastic connectors 50 have first ends 52 and second ends 54. The first end 52 for sliding onto one of the upright's connection pins 34 and the second end 54 for attaching with the pocket 40, which holds the ball. The preferred elastic connectors 50 comprising lengths of standard surgical tubing. However, other types of elastic connectors and manners of attachment are envisioned. The other types of elastic connectors include, but are not limited to, sheets of elastic, elastic rope, and woven elastic rope. Preferably, four elastic connectors 50 are utilized.

It is preferred that the present invention be provided with a pouch or pocket 40 for holding the ball therein when the ball 2 is being prepared for being fired. The preferred pocket comprised of leather, fabric or other material. The pocket 40 providing a manner of holding the ball 2 during this process. As such, any and all other manners of holding a ball are also included in this disclosure, including, but not limited to cups, bands, boxes, slits, slots, and grooves. The pocket shown in FIG. 1 defining a rim 42.

Figure 4:
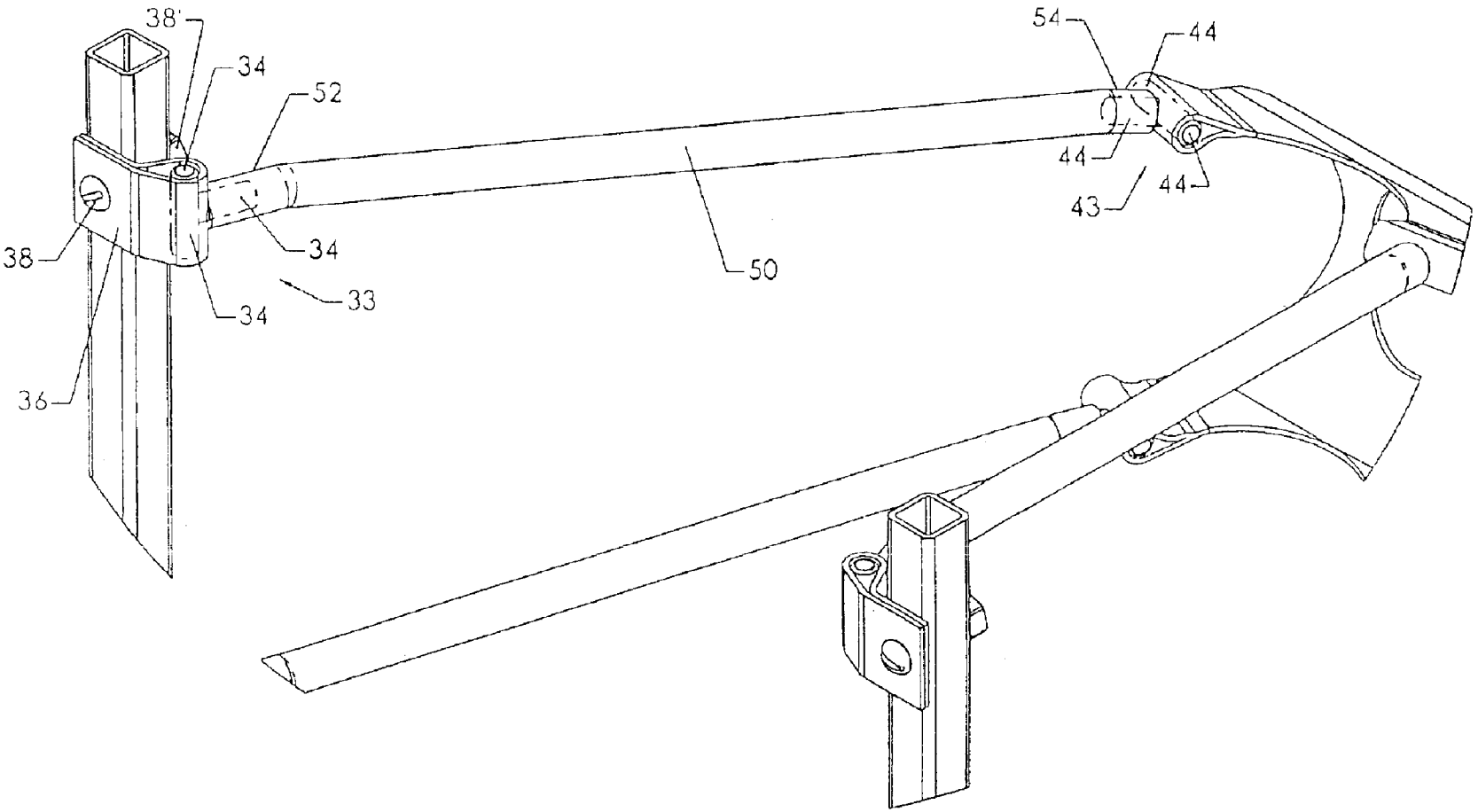
FIG. 4 shows a partial, perspective view of a portion of FIG. 1.
Figure 5:
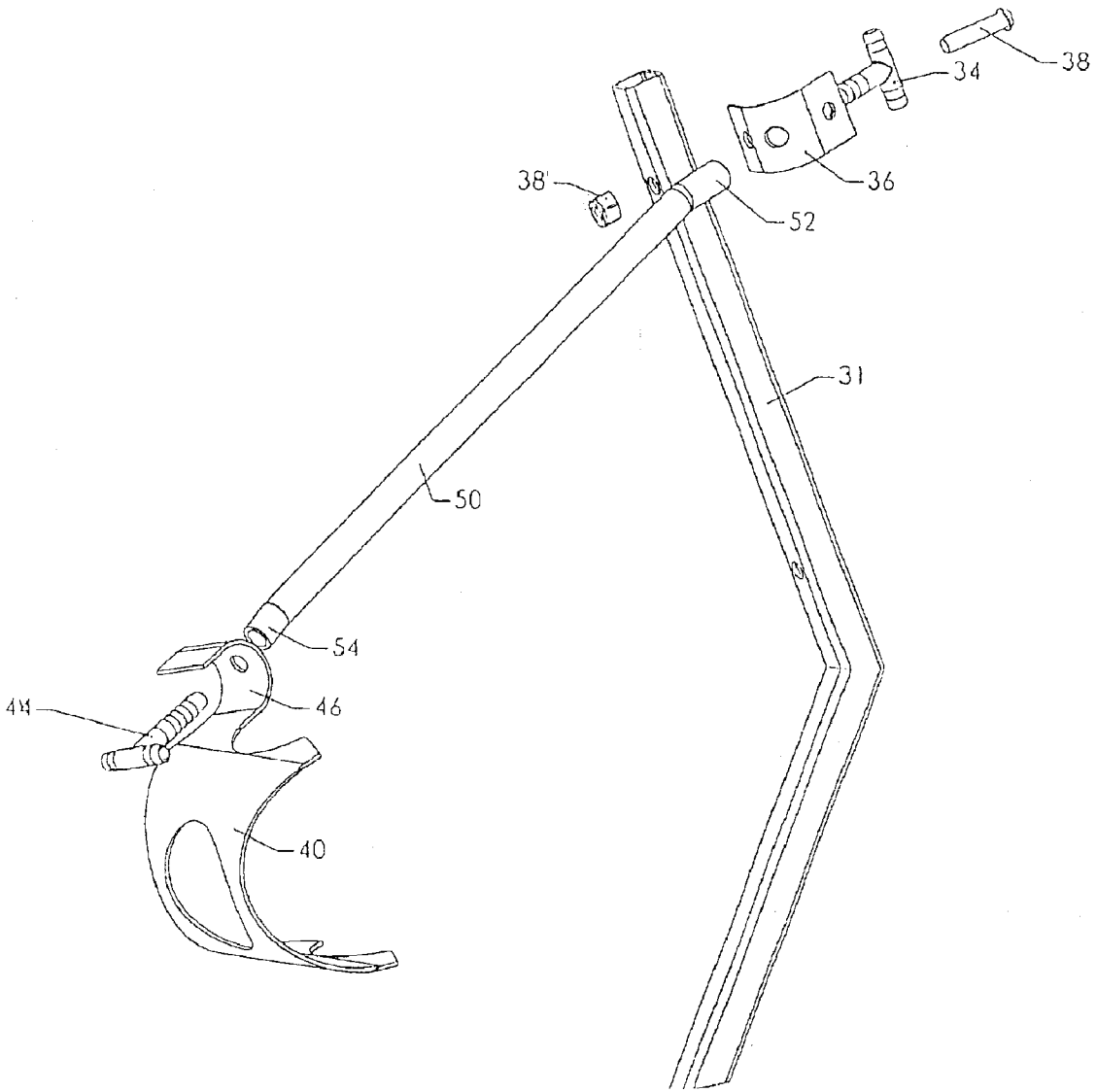
FIG. 5 shows a rotated, partial, exploded, perspective view of a portion of FIG. 4.

Preferably, a plurality of connection barbs 44 attach to the pocket 40 and extend away there from. The pocket 40 being configured for attachment to one or more elastic connectors 50. Any suitable connector 43 for attaching the elastic connectors 50 to the pocket is permissible. The preferred connector style is shown in FIGS. 4–5. This connector 43 utilizing a connection pin holder 46 for holding a T-shaped connection pin 44. This connection pin holder 46 defining a hole through which the leg of the T-shape can extend there through, this leg configured for insertion within one of the second ends 54 of one of the elastic connectors 50. The preferred connection pin 44 comprising a barbed hose "T" made of PVC, nylon or another suitable plastic. Metal and composite "T's" are also available and are suitable. In the embodiment shown, the connection pin holder 46 is formed by folding over a tab of the pocket and sewing the connection pin therein. Other manners of attaching the connection pin to the pocket are also envisioned.

With the elastic connector connecting the pocket to the uprights, pulling away from the upright upon the pocket results in the stretching of the elastic connectors. If a ball is placed within the pocket and drawn in such a direction and then released, the ball will be fired out of the pocket in a catapult-like fashion through the uprights.

The embodiment of the present invention shown in FIG. 1 is designed to break down into a number of parts as shown in FIG. 3, namely a main body with a ball basket, a scat that also serves as the basket lid in the compact form, two sets of U-shaped legs designed for use on household or gym floors or on direct or grass fields, sling poles that are attached to the end of the bench to which the surgical tubing lengths with the attached pouch are connected, surgical tubing, a pouch, and barbed tee connectors. The present invention is stored in storage container 60 having one or more handles 62, 62' as shown in FIG. 6. While such a configuration is preferred, other configurations and manners of assembly/disassembly are also envisioned, including, but not limited to, the use of hinges and supports.

One embodiment of the invented portable pitching machine for pitching balls to a batter comprises a frame, a pair of uprights, at least one pocket, and a plurality of elastic connectors. The frame comprising a seat configured for sitting upon by a user. The pair of uprights are configured to attach to and extend from the frame and are configured for attachment to the elastic connectors. The pocket is configured for attachment to the elastic connectors as well, and thus the elastic connectors are configured to attach between the uprights and the pocket.

In this embodiment, the frame comprises a plurality of legs configured for resting upon a ground surface. These legs can be U-shaped (preferred) or may comprise four separate legs each having feet for contacting the ground surface. Other configurations of legs are also envisioned. The pocket is configured to define a rim. A plurality of connection barbs preferably extend from the rim, these barbs configured for connecting the pocket to the second ends of the elastic connectors.

In this embodiment, the elastic connectors comprise lengths of surgical tubing. These elastic connectors having a first end extending to a second end. The uprights also comprising a plurality of connection pins configured for connection to the first ends of the elastic connectors. As such, the elastic connectors connect between the uprights and the pocket. Optionally, the uprights can be configured for vertical adjustment.

In this embodiment, the frame defines an open top container for storing balls. This open top container configured for access by a user sitting on the seat. This open top container preferably located between the seat and the uprights so that a user sitting on the seat is able to conveniently retrieve balls to be fired using the present invention.

In this embodiment, it is preferred that the invented portable pitching machine be convertible from a storage mode to an in use mode. When in the storage mode, the seat comprises the top for the open top container, thereby allowing balls stored within the open top container to be retained therein and not spilled out thereof. Likewise, when in the in use mode, the seat does not comprise a top for the open top container. The present invention further utilizing a storage container or bag configured for receiving therein the portable pitching machine when the portable pitching machine is in its storage mode. The storage container having at least one handle for allowing a user to pick up and carry said storage container containing the portable pitching machine therein. The preferred storage container comprising a zippered bag into which the portable pitching machine is placed.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A portable pitching machine for pitching balls to a batter, said portable pitching machine comprising:

a frame, said frame comprising a seat configured for sitting upon by a user;

a pair of uprights configured to attach to and extend from said frame, said pair of uprights configured for attachment to a plurality of elastic connectors;

at least one pocket for containing at least one ball, said pocket configured for attachment to said plurality of elastic connectors; and said plurality of elastic connectors, said elastic connectors configured to attach between said uprights and said pocket;

wherein said frame defines an open top container for storing said ball, said open top container configured for access by a user sitting on said seat, said open top container located between said seat and said uprights, and wherein said portable pitching machine is convertible from a storage mode to an in-use-mode, wherein when in said storage mode said seat comprises a top for said open top container, wherein when in said in-use-mode said seat does not comprise a top for said open top container.

2. The portable pitching machine of claim 1, wherein said frame comprises a plurality of legs configured for resting upon a ground surface.

3. The portable pitching machine of claim 1, wherein said elastic connectors comprise lengths of surgical tubing.

4. The portable pitching machine of claim 1, wherein said elastic connectors have a first end extending to a second end.

5. The portable pitching machine of claim 4, wherein said pocket defines a rim, said pocket comprising a number of connection barbs extending from said rim, said barbs configured for connecting said pocket to said second ends.

6. The portable pitching machine of claim 5, wherein said uprights comprise a plurality of connection pins configured for connection to said first ends.

7. The portable pitching machine of claim 1, further comprising a storage container configured for receiving therein said portable pitching machine when said portable pitching machine is in said storage mode, said storage container comprising at least one handle.

8. A portable pitching machine for pitching balls to a batter, said portable pitching machine comprising:

a frame, said frame comprising a seat configured for sitting upon by a user, said frame defining an open top container for storing balls, said open top container configured for access by a user sitting on said seat, said open top container located between said seat and a pair of uprights extending from said frame;

said pair of uprights configured to attach to and extend from said frame, said pair of uprights configured for attachment to a plurality of elastic connectors;

at least one pocket for containing one of said balls, said pocket configured for attachment to said plurality of elastic connectors; and said plurality of elastic connectors, said elastic connectors configured to attach between said uprights and said pocket.

9. The portable pitching machine of claim 8, wherein said frame comprises a plurality of legs configured for resting upon a ground surface.

10. The portable pitching machine of claim 8, wherein said elastic connectors comprise lengths of surgical tubing.

11. The portable pitching machine of claim 10, wherein said elastic connectors have a first end extending to a second end.

12. The portable pitching machine of claim 8, wherein said pocket defines a rim, said pocket comprising a number of connection barbs extending from said rim, said barbs configured for connecting said pocket to said second ends.

13. The portable pitching machine of claim 12, wherein said uprights comprise a plurality of connection pins configured for connection to said first ends.

14. The portable pitching machine of claim 8, wherein said portable pitching machine is convertible from a storage mode to an in-use-mode, wherein when in said storage mode said seat comprises a top for said open top container, wherein when in said in-use-mode said seat does not comprise a top for said open top container.

15. The portable pitching machine of claim 14, further comprising a storage container configured for receiving therein said portable pitching machine when said portable pitching machine is in said storage mode, said storage container comprising at least one handle.

16. A portable pitching machine for pitching balls to a batter, said portable pitching machine convertible from a storage mode to an in use mode, said portable pitching machine comprising:

a frame, said frame having a plurality of legs configured for resting upon a ground surface, said frame comprising a seat configured for sitting upon by a user, said frame defining an open top container for storing at least one ball, said open top container configured to be accessible by a user sitting on said seat, said open top container located between said seat and a pair of uprights extending from said frame, wherein when in said storage mode said seat comprises a top for said open top container, wherein when in said in use mode said seat does not comprise a top for said open top container;

a plurality of elastic connectors, said elastic connectors comprising lengths of surgical tubing, each of said elastic connectors having a first end extending to a second end;

said pair of uprights extending from said frame, said uprights comprising a plurality of connection pins configured for connecting with said elastic connector first ends;

a pocket for containing said at least one ball, said pocket defining a rim, said pocket comprising a number of connection barbs extending from said rim, said barbs configured for connecting said pocket to said elastic connector second ends; and a storage container configured for receiving therein said portable pitching machine when said portable pitching machine is in said storage mode, said storage container comprising at least one handle.

* * * * *